US009683570B2

(12) United States Patent
Heaps et al.

(10) Patent No.: US 9,683,570 B2
(45) Date of Patent: Jun. 20, 2017

(54) VACUUM PUMP

(75) Inventors: David Heaps, Haworth (GB); Simon Warner, Wakefield (GB); John Hegarty, Wakefield (GB)

(73) Assignee: Wabco Automotive UK Limited (GB)

( * ) Notice: Subject to any disclaimer, the term of this patent is extended or adjusted under 35 U.S.C. 154(b) by 442 days.

(21) Appl. No.: 14/238,806

(22) PCT Filed: Aug. 15, 2012

(86) PCT No.: PCT/EP2012/065946
§ 371 (c)(1),
(2), (4) Date: Jul. 31, 2014

(87) PCT Pub. No.: WO2013/024117
PCT Pub. Date: Feb. 21, 2013

(65) Prior Publication Data

US 2014/0334960 A1 Nov. 13, 2014

(30) Foreign Application Priority Data

Aug. 17, 2011 (EP) ..... 11177756

(51) Int. Cl.
*F04C 29/02* (2006.01)
*F04C 18/356* (2006.01)
(Continued)

(52) U.S. Cl.
CPC ..... *F04C 29/02* (2013.01); *F04C 29/021* (2013.01); *F04C 29/023* (2013.01);
(Continued)

(58) Field of Classification Search
CPC ..... F04C 15/0076; F04C 15/08
(Continued)

(56) References Cited

U.S. PATENT DOCUMENTS 2,654,532 A 4/1948 Nichols
2,737,341 A 2/1950 Bitzer
(Continued)

FOREIGN PATENT DOCUMENTS

DE 2952401 6/1981
DE 3325261 1/1985
(Continued)

OTHER PUBLICATIONS

International Search Report and Written Opinion dated Jun. 28, 2013 in corresponding International Application No. PCT/EP2012/065946.

(Continued)

*Primary Examiner* — Mark Laurenzi
*Assistant Examiner* — Anthony Ayala Delgado
(74) *Attorney, Agent, or Firm* — Downs Rachlin Martin PLLC

(57) ABSTRACT

The present invention relates to an automotive vacuum pump 10. The vacuum pump 10 has a casing 12 defining a cavity having an inlet 14 and an outlet 16, wherein the cavity contains a rotor 18 and a vane slidably mounted to the rotor 18. The rotor 18 extends through a side 21 of the casing 12 to the exterior thereof and is provided with a coupling arrangement 26 to couple the rotor 18 to a drive member. The vacuum pump 10 is provided with a lubrication conduit 50, 56, 66, 68, 70, 72, 74 for the supply of lubricating fluid to the coupling arrangement 26, the conduit 50, 56, 66, 68, 70, 72, 74 including a portion 70, 72, 74 which extends through the rotor 18 and the coupling arrangement 26.

20 Claims, 5 Drawing Sheets

(51) Int. Cl.
*F04C 25/02* (2006.01)
*F04C 29/00* (2006.01)
*F04C 18/344* (2006.01)

(52) U.S. Cl.
CPC ..... *F04C 18/344* (2013.01); *F04C 25/02* (2013.01); *F04C 29/0071* (2013.01); *F04C 2220/10* (2013.01); *F04C 2240/20* (2013.01)

(58) Field of Classification Search
USPC ..... 418/55.394, 93, 94, 96–100, 106, 150, 418/188, 253–255, 259, 266–268
See application file for complete search history.

(56) References Cited

U.S. PATENT DOCUMENTS

| | | | | |
|---|---|---|---|---|
| 3,707,339 | A | 12/1972 | Budgen | |
| 4,478,562 | A * | 10/1984 | Schippers | B60T 17/02 137/624.13 |
| 4,604,041 | A | 8/1986 | Hertell et al. | |
| 5,181,414 | A | 1/1993 | Baret et al. | |
| 5,236,313 | A | 8/1993 | Kim | |
| 6,019,585 | A | 2/2000 | Abelen et al. | |
| 6,190,149 | B1 | 2/2001 | Richman | |
| 7,896,631 | B2 | 3/2011 | Kishi et al. | |
| 8,628,317 | B2 | 1/2014 | Heaps et al. | |
| 2002/0100507 | A1 | 8/2002 | Hauser et al. | |
| 2008/0240962 | A1 | 10/2008 | Ono et al. | |
| 2010/0239440 | A1 | 9/2010 | Heaps et al. | |

FOREIGN PATENT DOCUMENTS

| | | |
|---|---|---|
| DE | 3841329 | 6/1989 |
| DE | 19647053 | 4/1998 |
| DE | 10260546 | 7/2004 |
| EP | 0003572 | 8/1979 |
| EP | 0761975 | 3/1997 |
| EP | 1120568 | 8/2001 |
| EP | 2108841 | 10/2009 |
| GB | 594441 | 11/1947 |
| GB | 796924 | 6/1958 |
| GB | 1327521 | 8/1973 |
| GB | 2069610 | 8/1981 |
| GB | 2211572 | 7/1989 |
| GB | 2267538 | 12/1993 |
| JP | 49011645 | 3/1974 |
| JP | 55134784 | 10/1980 |
| JP | 59180095 | 10/1984 |
| JP | 62048987 | 3/1987 |
| JP | 62174591 | 7/1987 |
| JP | 63193788 | 8/1988 |
| JP | 1164670 | 6/1989 |
| JP | 7208339 A | 8/1995 |
| JP | 10238469 | 9/1998 |
| JP | 5088391 | 2/1999 |
| JP | 3070980 | 8/2000 |
| JP | 2001248741 | 9/2001 |
| JP | 2002005036 | 1/2002 |
| JP | 2003343462 | 12/2003 |
| JP | 2004011421 | 1/2004 |
| JP | 2004092504 | 3/2004 |
| JP | 2005256684 | 9/2005 |
| WO | 9103646 | 3/1991 |
| WO | 2006024872 | 3/2006 |
| WO | 2007116216 | 10/2007 |

OTHER PUBLICATIONS

International Search Report issued Jul. 19, 2007, in International Application No. PCT/GB2007/001314 filed on Apr. 5, 2007.
UK Patent Office Search Report issued Dec. 5, 2006, in United Kingdom Application No. 0607198.9 filed on Apr. 10, 2006.
Minivac Vane Pumps (http://web.archive.org/web/20050214035516/http://minivacpumps.com/oillubricated.html dated Feb. 14, 2005.
Office Action Summary dated Dec. 20, 2011, in related JP Patent Application No. 2009-504812.
Office Action Summary dated Oct. 23, 2012, in related JP Patent Application No. 2009-504812.

* cited by examiner

VACUUM PUMP

FIELD OF THE INVENTION

The present invention relates to an automotive vacuum pump and particularly to the lubrication of a drive coupling of an automotive vacuum pump.

BACKGROUND

For many years the partial vacuum created in the inlet manifold of a petrol engine has been utilized to exhaust the reservoir of a vacuum brake servo, thereby to provide power assistance for the vehicle brakes. Such a system is simple and extremely reliable.

The vacuum available from the inlet manifold of a petrol engine may however be insufficient to meet brake servo demand in certain conditions of use. Furthermore the vacuum source may also be required for operation of other devices such as exhaust gas recirculation (EGR) valves.

Diesel engines have an unthrottled air supply and thus the partial vacuum in the inlet manifold is only marginally below atmospheric pressure; consequently a useful vacuum source is not available. Accordingly mechanically operated vacuum pumps have been proposed for cars and light trucks equipped with a conventional vacuum brake servo. Such pumps may driven from the engine camshaft by, for example, an axially aligned drive coupling, a camshaft follower or a belt driven pulley arrangement.

In instances where the pump is driven by a drive coupling, it is highly desirable to lubricate engagement faces of the drive coupling so that the drive coupling does not wear excessively. One manner in which the drive coupling can be lubricated is by positioning the outlet to the vacuum pump such that oil expelled through the pump outlet impinges upon the drive coupling. The oil used for lubricating the drive coupling is thus oil that has previously been admitted into a vacuum generating chamber of the pump for the purpose of sealing clearances between moving parts of the pump.

The position in which the pump is located and/or the manner in which the pump is mounted to the engine may prevent the pump outlet being provided in a position where it is able to direct oil onto the drive coupling. Alternatively, the pump may be of a type which does not need oil to be introduced into the pump chamber in order to seal clearances, and thus there is no oil expelled through the outlet which could be used to lubricate the drive coupling.

SUMMARY OF THE DISCLOSURE

According to a first aspect of the present invention there is provided an automotive vacuum pump, the vacuum pump having a casing defining a cavity, the casing having an inlet and an outlet, wherein the cavity contains a rotor and a vane slidably mounted to the rotor, the rotor extending through a side of the casing to the exterior thereof and being provided with a coupling arrangement to couple the rotor to a drive member, wherein the vacuum pump is provided with a lubrication conduit for the supply of lubricating fluid to the coupling arrangement independently to the supply of any lubricating fluid to the pump cavity, the conduit including a portion which extends through the rotor and the coupling arrangement.

Lubrication fluid, typically the same oil which is used to lubricate an the engine to which the vacuum pump is connected, is thus supplied to the coupling arrangement from within the vacuum pump. Lubrication of the drive coupling is thus not dependent upon oil being admitted to the pump cavity.

The oil is able to exit the conduit at an outlet and thereafter lubricate engagement faces of the coupling arrangement.

In a preferred embodiment, the portion of the lubrication conduit extending through the coupling arrangement is aligned parallel with the axis of rotation of the rotor. In such an embodiment, the portion of the lubrication conduit extending through the coupling arrangement is coaxial with the axis of rotation of the rotor.

In a preferred embodiment a first section of the portion of the lubrication conduit extending through the rotor is aligned parallel with the axis of rotation of the rotor. In such an embodiment, the section of the portion of the lubrication conduit extending through the coupling arrangement is coaxial with the axis of rotation of the rotor. A further section of the lubrication conduit which extends through the rotor may be provided in a direction which is transverse to the axis of rotation of the rotor. In such an embodiment, the further section may extend radially from the first section to the exterior of the rotor. The rotor may be provided with a groove which extends at least partially around the periphery thereof, wherein said further section is connected to said groove. In a preferred embodiment the groove extends fully around the periphery of the rotor.

The lubrication conduit preferably includes a portion which extends through the casing of the vacuum pump between a lubrication fluid inlet and location which is in communication with the portion of the lubrication conduit which extends through the rotor and coupling arrangement. Said location may be a space defined between the rotor and the casing, through which space the groove of the rotor passes. The lubrication fluid inlet may by provided in the same side of the casing as that which the rotor extends.

The coupling arrangement is preferably connected to the rotor by a connecting member which extends though the coupling arrangement and into the rotor. The connecting member may preferably be at least partially located within the through the portion of the lubrication conduit which extends through the rotor and the coupling arrangement. The connecting member may be provided upon its outer surface with formations which, in use, promote the flow of lubricating fluid.

In a preferred embodiment the pump is provided with a single vane that is provided in a slot that extends across the rotor.

According to a further aspect of the present invention there is provided a vehicle engine having a vacuum pump of the type hereinbefore described.

According to a further aspect of the present invention there is provided a vehicle including an engine having a vacuum pump of the type hereinbefore described.

BRIEF DESCRIPTION OF THE DRAWINGS

An embodiment of the present invention will now be described with reference to the accompanying drawings in which.

DETAILED DESCRIPTION

Figure 1:
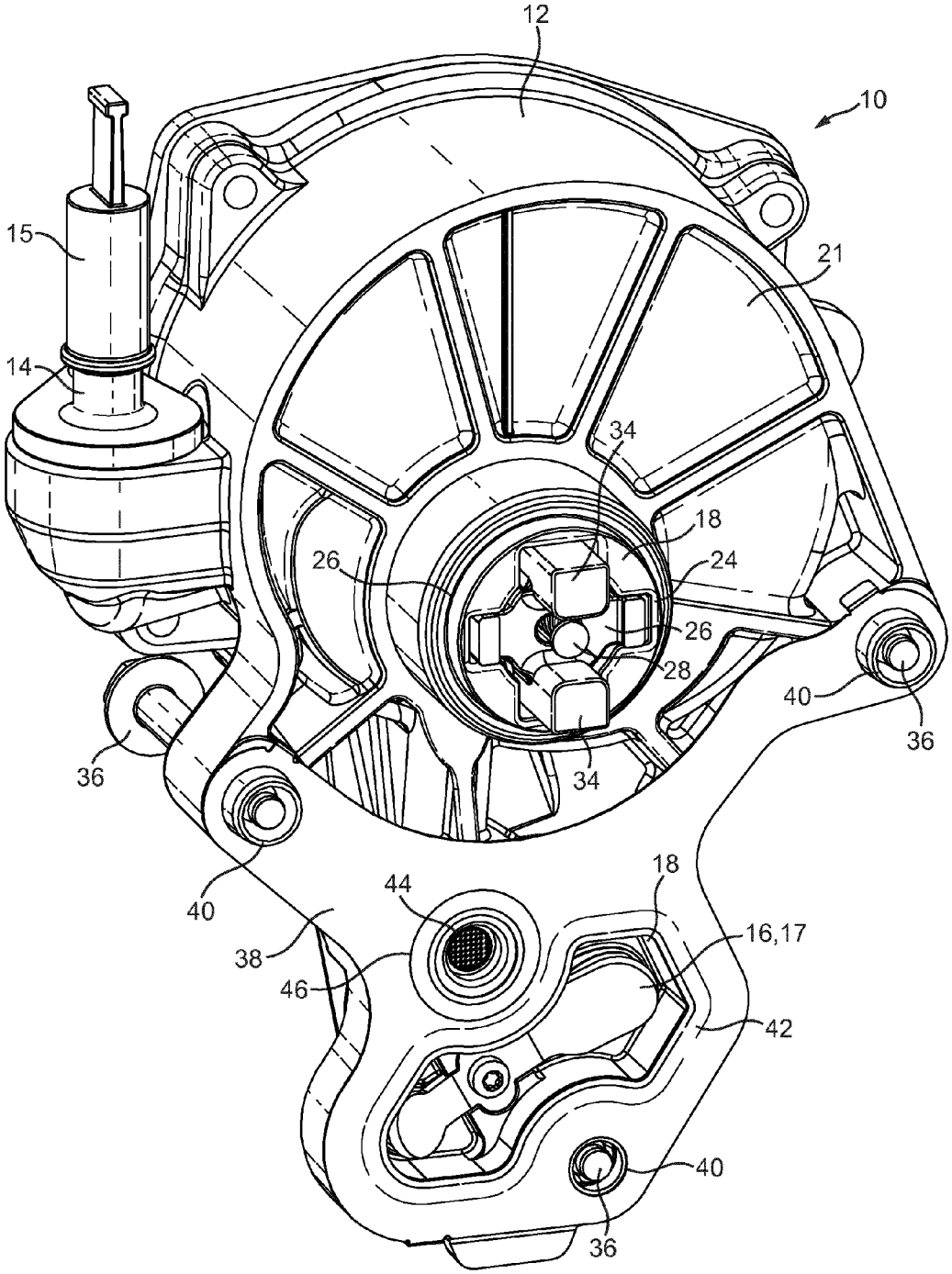
FIG. 1 shows a perspective view of a face of an automotive vacuum pump having drive coupling extending therefrom.
Figure 2:
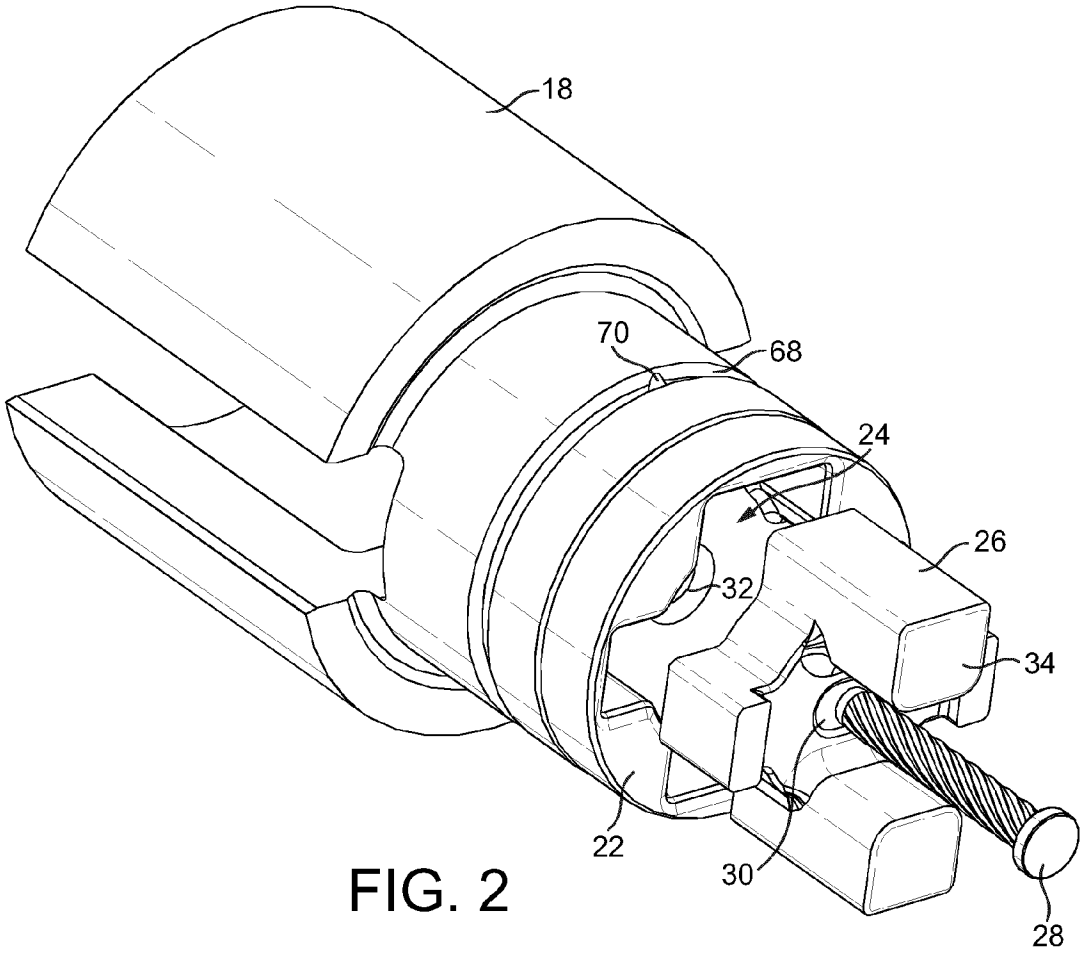
FIG. 2 shows a perspective view of a rotor, drive coupler and coupling pin of the vacuum pump of FIG. 1.
Figure 3:
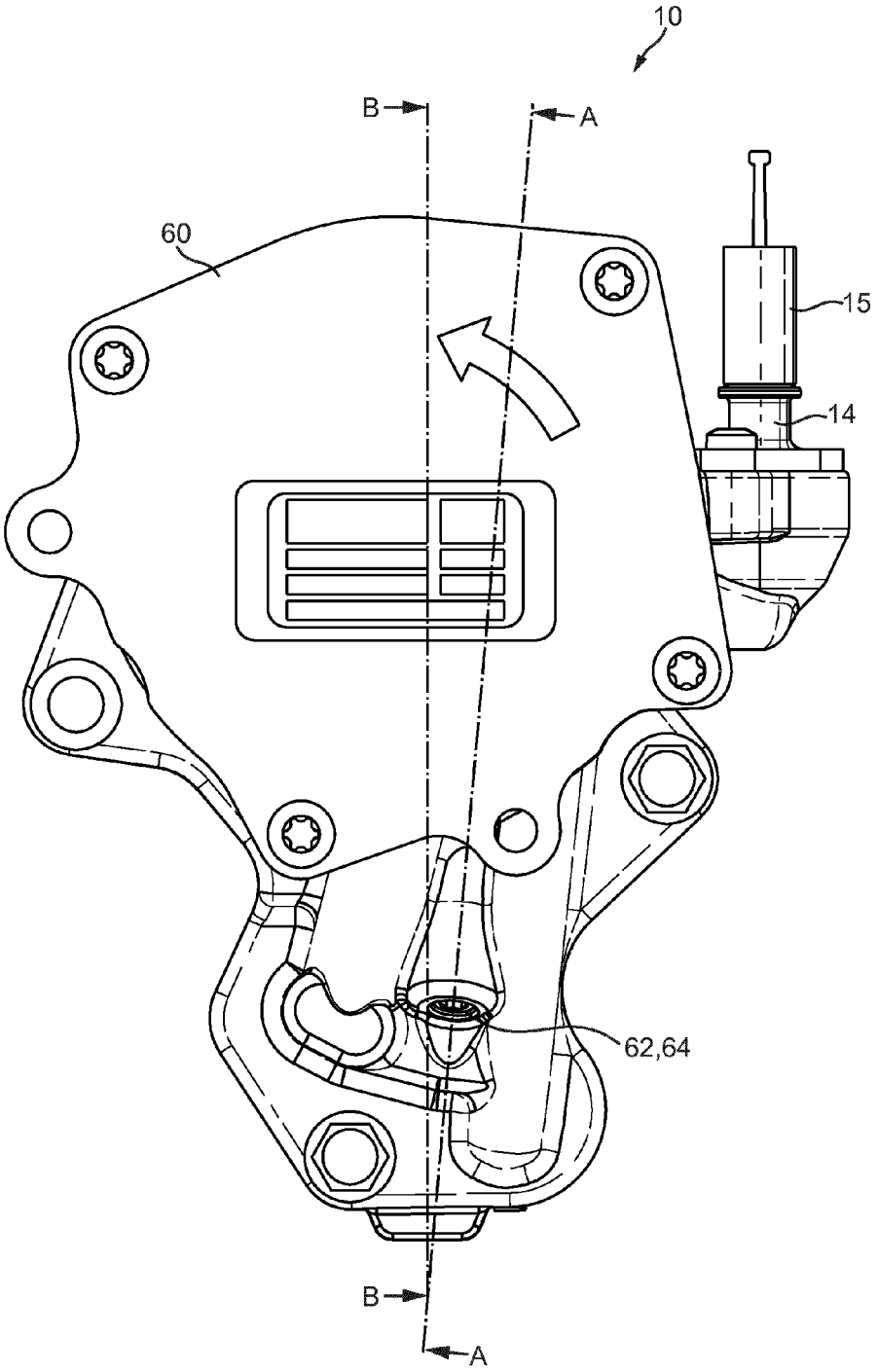
FIG. 3 shows an end view of the vacuum pump of FIG. 1.

Referring to the figures there is shown a vacuum pump generally designated 10. The pump 10 includes a casing 12 having an inlet 14 and an outlet 16. The inlet 14 is shown with a protective cap or cover 15 which is removed before use. The outlet 16 includes a reed valve 17 The casing 12 includes a cavity (not shown). Within the cavity there is provided a rotor 18 having at least one vane slidably mounted thereto. The pump 10 may of the single vane type where a single vane is slidably mounted to a slot which extends fully across the rotor 18. The rotor 18 extends through an aperture 20 of the casing 12 to the exterior of the casing 12. The rotor 18 extends through a rear side 21 of the casing 12, which is to say the side 21 of the casing 12 which faces a vehicle engine, in use.

In use, the rotor 18 is coupled to a rotatable element of a vehicle engine, for example a cam shaft of the vehicle engine. To effect coupling of the rotor 18 to the cam shaft, the end face 22 of the rotor 18 is provided with a cruciform shaped recess 24 into which a complimentarily cruciform shaped drive coupler 26 is received. The coupler 26 is retained in association with the rotor 18 by a coupling pin 28. The coupling pin 28 extends with a clearance through a through aperture 30 of the coupler 26, and is received in a blind aperture 32 of the rotor 18. The coupling pin 28 is retained in the blind aperture 32 by an interference fit. The coupler 26 is provided with two projections 34 which, in use, are received in complementarily shaped recess of a cam shaft (not shown).

The pump 10, in use, is connected to the vehicle engine by three bolts 36 which extend through apertures of the casing 12. The casing 12 is further provided with a gasket or seal 38 which sits between the casing 12 and the vehicle engine. The gasket 38 includes apertures 40 for the bolts 36 and a further aperture 42 which surrounds the pump outlet 16 and reed valve 17.

In use, lubricating oil drawn from the engine lubrication system is fed into the pump cavity to effect sealing of the vane tips. The lubricating oil is ejected through the pump outlet 16 and returned to the sump of the engine. It will be appreciated that the presence of the gasket 38 which surrounds the outlet 18 prevents the ejected lubricating oil from contacting the drive coupler 26 and thereby lubricating the connection of the drive coupler 26 to the engine cam shaft in the manner known from the prior art.

In order to lubricate the drive coupler 26, and in accordance with the present invention, there is provided a separate lubrication system which supplies lubricating oil to the drive coupler through the casing 12 and the rotor 18 independently to the supply of lubricating oil to the pump cavity to effect sealing of the vane tips.

Figure 4:
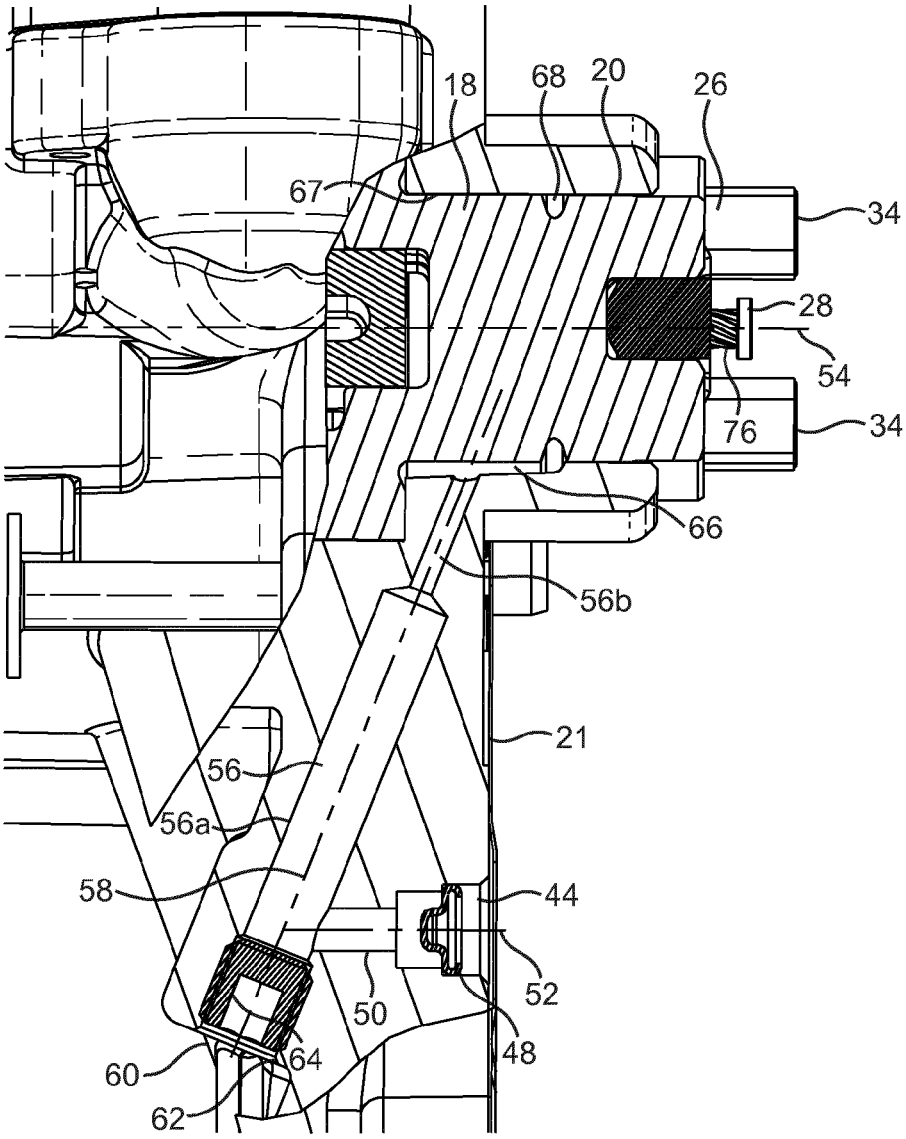
FIG. 4 shows a partial cross-sectional view of the pump of FIG. 1 indicated by arrows A-A of FIG. 3.

The casing 12 is provided with an oil inlet 44 through which lubricating oil can be introduced into the casing 12. The inlet 44 is provided in the rear side 21 of the casing and is aligned with an aperture 46 of the gasket 38. In use, the aperture aligns with an oil supply aperture of the vehicle engine. FIG. 4 shows the oil inlet 44 fitted with an insert 48 which functions as a combined oil filter and restriction orifice. The oil inlet 44 communicates with a first oil passageway 50. The oil inlet and first oil passageway 44,50 are aligned along an axis 52 which is substantially parallel with the rotational axis 54 of the rotor 18. The first oil passageway 50 connects to a second oil passageway 56 which extends through the casing 12. The second oil passageway 56 extends along an axis 58 which is inclined relative to the axes 52,54 of the first oil passageway 50 and the rotor 18, and further intersects said axes 52,54. The second oil passageway 56 thus extends through the casing 12 from the first oil passageway to the casing aperture 20 through which the rotor 18 extends.

The second oil passageway 56 is realised by drilling in the direction of the rotor aperture 20 through the casing 12 from the front side 60 thereof. It will be understood that the term "front" refers to the side of the casing 12 which is opposite to the one which faces the vehicle; engine, in use. The opening 62 in the front side 60 of the casing is closed with a threaded plug 64. The second oil passageway 56 comprises a first portion 56*a* and a second portion 56*b*, wherein the first portion 56*a* has a larger diameter than the second portion 56*b*.

Figure 5:
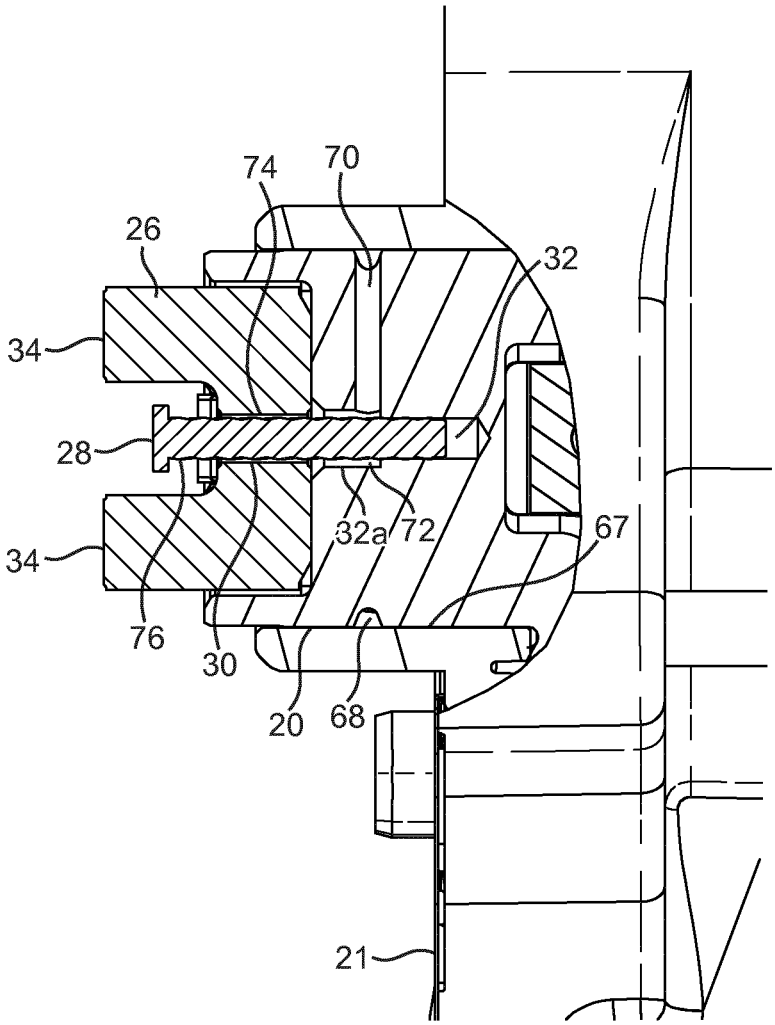
FIG. 5 shows a further partial cross-sectional view of the pump of FIG. 1 indicated by arrows B-B of FIG. 3.

The second oil passageway 56 connects to an oil gallery 66 provided in the rotor aperture 20. The oil gallery 66 is in the form of an axially extending groove provided in a substantially cylindrical bearing surface 67 of the casing 12. Then bearing surface 67 supports the rotor 18. The oil gallery 66 extends partially around the rotor aperture 20. The rotor 18 is provided with a circumferential recess 68. The recess 68 is positioned axially on the on the rotor 18 such that it overlies the oil gallery 66. The rotor 18 is further provided with a radially extending oil passageway 70 which extends from the circumferential recess 68 to the blind aperture 32 provided in the rotor 18. As can be seen from FIG. 5, the radial oil passageway 70 intersects with a portion 32*a* of the blind aperture 32 proximal to the drive coupler 26 which has greater diameter than the outer diameter of the coupling pin 28. The proximal portion 32*a* and the coupling pin 20 thus define an annular oil conduit 72 which extends from the point of intersection of the radial oil passageway 70 with the blind aperture 32 in the direction of the drive coupler 26. The proximal portion 32*a* is flared in the direction of the drive coupler 26 such that the diameter of the proximal portion 32*a* of the blind aperture 32 which faces the drive coupler 26 is greater than the diameter of the through aperture 30 of the coupler 26. As can also be seen from FIG. 5, the diameter of the through aperture 30 of the drive coupler 26 is greater than the outer diameter of the coupling pin 28 and thus an annular oil conduit 74 is defined through the drive coupler 26. The dimensions of the annular oil conduit 74 can be chosen such that the conduit 74 acts as a restriction and thus meters oil at a desired rate to the drive coupler 26.

The surface of the coupling pin 28 is provided with a plurality of helical grooves 76 which assist in the retention of the pin 28 in the blind aperture 30. The helical grooves 76 may also due to the rotation of the coupling pin 28, in use, urge oil present within the annular conduits 72,74 in the direction of the coupler projections 34

In use, lubricating oil under pressure is supplied to the oil inlet 44. The lubricating oil 44 passes through the first oil passageway 50 to the second oil passageway 56 and then to the oil gallery 66. From the oil gallery 66, the oil passes to the circumferential recess 68 of the rotor and then into the radial oil passageway 70, before reaching the annular conduits 72,74 provided within the rotor 18 and drive coupler 26 respectively. The majority of the oil exits the annular conduit 74 of the drive coupler 26 and is urged onto the coupler projections 34 due to rotation of the rotor 18 and drive coupler 26. Due to the flaring of the proximal portion 32*a* of the blind aperture 32 a proportion of the oil which exits the radial passageway 70 will contact the rear face 78 of the drive coupler 26. This oil is able to flow between the drive coupler 26 and the rotor 18 and thus lubricate the contact area between the rear face 78 of the drive coupler 26 and the rotor 18. The oil is also able to flow onto the projections 34 of the drive coupler 26 and this between the projections 34 and the complementarily shaped recess of the cam shaft. The lubrication of the engagement faces of the coupling arrangement is thus achieved.

In the embodiment described above, the supply of oil to lubricate the coupling arrangement is undertaken in addition to the separate supply of oil to pump cavity to seal the tips of the vane. It will be understood that the coupling arrangement lubrication system of the present invention is equally applicable to vacuum pumps which do not require oil to the supplied to the pump cavity to seal the tips of the vane.

10—Vacuum pump
12—Casing
14—Inlet
15—Protective cap
16—Outlet
17—Reed valve
18—Rotor
20—Aperture
21—Casing rear side
22—End face
24—Cruciform shaped recess
26—Drive coupler
28—Coupling pin
30—Through aperture
32—Blind aperture
32*a*—Blind aperture portion
34—Projection
36—Bolt
38—Gasket
40—Aperture
42—Aperture
44—Oil inlet
46—Aperture
48—Insert
50—First oil passageway
52—Axis
54—Rotational axis
56—Second oil passageway
56*a*—Second oil passageway first portion
56*b*—Second oil passageway second portion
58—Axis
60—Casing front side
62—Opening
64—Threaded plug
66—Oil gallery
67—Bearing surface
68—Circumferential recess
70—Oil passageway
72—Annular oil conduit
74—Annular oil conduit
76—Helical groove
78—Drive coupler rear face

The invention claimed is:

1. An automotive vacuum pump, comprising: a casing defining a cavity, the casing having an inlet and an outlet;

wherein the cavity contains a rotor and a vane slidably mounted to the rotor, the rotor extending through a side of the casing to an exterior thereof and being provided with a coupling arrangement to couple the rotor to a drive member; and wherein the automotive vacuum pump is provided with a lubrication conduit that supplies a lubricating fluid to the coupling arrangement to lubricate the coupling arrangement and does not supply the lubricating fluid to the vane, the lubrication conduit including a portion which extends through the rotor and the coupling arrangement.

2. An automotive vacuum pump as claimed in claim 1 wherein the portion of the lubrication conduit extending through the coupling arrangement is aligned parallel with an axis of rotation of the rotor.

3. An automotive vacuum pump as claimed in claim 2 wherein the portion of the lubrication conduit extending through the coupling arrangement is coaxial with the axis of rotation of the rotor.

4. An automotive vacuum pump as claimed in claim 1 wherein a first section of the portion of the lubrication conduit extending through the rotor is aligned parallel with an axis of rotation of the rotor.

5. An automotive vacuum pump as claimed in claim 4 wherein the first section of the portion of the lubrication conduit extending through the rotor is coaxial with the axis of rotation of the rotor.

6. An automotive vacuum pump as claimed in claim 4 or claim 5 wherein a further section of the portion of the lubrication conduit which extends through the rotor is provided in a direction which is transverse to the axis of rotation of the rotor.

7. An automotive vacuum pump as claimed in claim 6 wherein the further section extends radially from the first section to the exterior of the rotor.

8. An automotive vacuum pump as claimed in claim 6 wherein the rotor is provided with a groove which extends at least partially around a periphery thereof, wherein said further section is connected to said groove.

9. An automotive vacuum pump as claimed in claim 8 wherein the groove extends fully around the periphery of the rotor.

10. An automotive vacuum pump as claimed in claim 1 wherein the lubrication conduit includes a portion which extends through the casing of the automotive vacuum pump between a lubrication fluid inlet and a location which is in communication with the portion of the lubrication conduit which extends through the rotor and coupling arrangement.

11. An automotive vacuum pump as claimed in claim 10 wherein the rotor is provided with a groove which extends at least partially around a periphery thereof, further wherein said location is a space defined between the rotor and the casing, through which space the groove of the rotor passes.

12. An automotive vacuum pump as claimed in claim 10 wherein the lubrication fluid inlet is provided in the same side of the casing as that through which the rotor extends.

13. An automotive vacuum pump as claimed in claim 1 wherein the coupling arrangement is connected to the rotor by a connecting member which extends though the coupling arrangement and into the rotor.

14. An automotive vacuum pump as claimed in claim 13 wherein the connecting member is at least partially located within the portion of the lubrication conduit which extends through the rotor and the coupling arrangement.

15. An automotive vacuum pump as claimed in claim 13 wherein the connecting member is provided upon its outer surface with formations which, in use, promote the flow of lubricating fluid.

16. An automotive vacuum pump as claimed in claim 1 wherein the vane is a single vane that is slidably mounted in a slot that extends fully across the rotor.

17. A vehicle engine having a vacuum pump as claimed in claim 1.

18. A vehicle having an engine including a vacuum pump as claimed in claim 1.

19. An automotive vacuum pump as claimed in claim 1 wherein the lubrication conduit includes a first portion located in the rotor and a second portion located in the coupling arrangement, wherein the first portion is upstream of the second portion.

20. An automotive vacuum pump as claimed in claim 1 wherein the lubrication conduit includes a portion that extends through the rotor and the coupling arrangement to route the lubricating fluid through the rotor for delivery to the coupling arrangement for lubricating the coupling arrangement.

* * * * *